US011781273B2

(12) United States Patent
Kreutz et al.

(10) Patent No.: US 11,781,273 B2
(45) Date of Patent: Oct. 10, 2023

(54) GROUND COMPACTION APPARATUS FOR COMPACTING A SUBSOIL COVER LAYER, ASPHALT ROLLER, AND METHOD FOR OPERATING A GROUND COMPACTION APPARATUS

(71) Applicant: BOMAG GmbH, Boppard (DE)

(72) Inventors: Tobias Kreutz, Boppard (DE); Manfred Darscheid, Boppard (DE); Hendrik Stein, Boppard (DE)

(73) Assignee: BOMAG GmbH, Boppard (DE)

( * ) Notice: Subject to any disclaimer, the term of this patent is extended or adjusted under 35 U.S.C. 154(b) by 290 days.

(21) Appl. No.: 17/340,440

(22) Filed: Jun. 7, 2021

(65) Prior Publication Data

US 2021/0395958 A1 Dec. 23, 2021

(30) Foreign Application Priority Data

Jun. 19, 2020 (DE) ..... 102020003682.1

(51) Int. Cl.
*E01C 19/26* (2006.01)
*E01C 19/23* (2006.01)

(52) U.S. Cl.
CPC ..... *E01C 19/266* (2013.01); *E01C 19/236* (2013.01); *E01C 19/264* (2013.01)

(58) Field of Classification Search
CPC ..... E01C 19/236; E01C 19/264; E01C 19/266
USPC ..... 404/72–75, 84.05–104, 117, 124, 127, 404/132
See application file for complete search history.

(56) References Cited

U.S. PATENT DOCUMENTS 397,731 A * 2/1889 Laird et al. ..... E01C 19/236 404/124
2,191,958 A * 2/1940 Greiner ..... E01C 23/0933 299/102
5,304,013 A * 4/1994 Parsons ..... E01C 19/266 404/127

(Continued)

FOREIGN PATENT DOCUMENTS

DE 1939680 U 6/1966
DE 2061966 A1 * 7/1972 ..... E01C 23/09

(Continued)

OTHER PUBLICATIONS

German Patent and Trademark Office, Search Report, Application No. 10 2020 003 682.1, dated Apr. 30, 2021 (4 pages).

*Primary Examiner* — Raymond W Addie
(74) *Attorney, Agent, or Firm* — Wood Herron & Evans LLP

(57) ABSTRACT

The present invention relates to a ground compaction apparatus for compacting a subsoil cover layer, with at least one compaction roller, a cover edge processing apparatus comprising an edge processing roller and having a cut material deflector, the cut material deflector being mounted on the cover edge processing apparatus with the aid of a mounting device, the mounting device being configured such that the relative position of the at least one material guide surface of the cut material deflector can be changed automatically with respect to the adjustable roller holding device of the cover edge processing apparatus. The present invention also relates to an asphalt roller having such a ground compaction apparatus and a method for operating such a ground compaction apparatus.

17 Claims, 5 Drawing Sheets

(56) References Cited

U.S. PATENT DOCUMENTS

| | | | | |
|---|---|---|---|---|
| 6,287,048 | B1 * | 9/2001 | Hollon | E01C 19/264 404/84.2 |
| 6,351,930 | B1 * | 3/2002 | Byrne | A01G 3/062 172/17 |
| 8,500,363 | B1 * | 8/2013 | Ries | E01C 19/264 404/104 |
| 10,662,590 | B1 * | 5/2020 | Biberdorf | E01C 19/26 |
| 11,377,802 | B2 * | 7/2022 | Oetken | E01C 19/264 |
| 2015/0184347 | A1 | 7/2015 | Lantez et al. | |
| 2019/0211516 | A1 | 7/2019 | Laugwitz | |
| 2023/0115734 | A1 * | 4/2023 | Engel | E01C 19/40 404/114 |

FOREIGN PATENT DOCUMENTS

| | | | |
|---|---|---|---|
| DE | 2927883 | A1 | 1/1981 |
| DE | 3020796 | A1 | 12/1981 |
| DE | 8710179 | U1 | 9/1987 |
| DE | 9111398 | U1 | 12/1991 |
| DE | 202014010215 | U1 | 1/2015 |
| DE | 102016203321 | A1 | 6/2017 |
| DE | 102017011146 | A1 | 6/2019 |
| DE | 102018007825 | A1 | 4/2020 |

* cited by examiner

GROUND COMPACTION APPARATUS FOR COMPACTING A SUBSOIL COVER LAYER, ASPHALT ROLLER, AND METHOD FOR OPERATING A GROUND COMPACTION APPARATUS

CROSS-REFERENCE TO RELATED APPLICATION

The present application claims priority under 35 U.S.C. § 119 of German Patent Application No. 10 2020 003 682.1, filed Jun. 19, 2020, the disclosure of which is hereby incorporated herein by reference in its entirety

FIELD OF THE INVENTION

The present invention relates to a ground compaction apparatus for compacting a subsoil cover layer, an asphalt roller, and a method for operating a ground compaction apparatus.

BACKGROUND OF THE INVENTION

Ground compaction apparatuses are often used to compact a subsoil cover layer, such as an asphalt layer, in road construction or similar applications. What these ground compaction apparatuses have in common is that they comprise a compaction roller mounted on a support structure of the ground compaction apparatus for rotation about a horizontal traveling rotation axis extending transversely to a working direction. Said compaction roller has a cylindrical external surface that rolls on the underlying ground during compaction operation. Such a compaction roller may be, for example, a rubber tire in the case of rubber-tired rollers or a so-called drum, for example made of a steel material and/or a composite material. The latter may comprise a hollow-cylindrical drum shell whose often smooth external surface is used for ground compaction. In road construction, in particular, it is common for such ground compaction apparatuses to follow a road paver for recompaction and further post-processing of the applied asphalt mat. These are self-propelled ground compaction apparatuses, with often two or more such compaction rollers, such as, in particular, pivot-steered or articulated-steered tandem rollers. Generic rollers are disclosed, for example, in DE 10 2018 007 825 A1 and DE 10 2017 011 146 A1.

Post-processing operations that go beyond pure compaction include, for example, the application of chippings to increase the skid resistance of the road cover, or the defined shaping of the edge regions of the asphalt layer applied by the preceding road paver. The present invention relates to the post-processing of the edge regions of the applied asphalt mat using a cover edge processing apparatus arranged on the support structure. Such cover edge processing apparatuses are used to achieve shaping and/or cutting processing of the edge of the asphalt mat when the ground compaction apparatus passes over the asphalt mat. Specifically, a distinction can be made between edge cutters and edge pressers, both of which, however, have a quite comparable basic structure. Essential elements of such a cover edge processing apparatus include a, usually non-driven, edge processing roller, an adjustable roller holding device, in particular an adjustment arm, and an adjustment drive. The diameter of the edge processing roller is usually much smaller than the diameter of the compaction roller.

At least in an edge processing position, the edge processing roller further protrudes at least partially beyond the face of the compaction roller (drum) in the direction of the traveling rotation axis, in order to be able to cut and/or press the underlying ground adjacent to the compaction roller, in particular directly adjacent to it in the direction of the traveling rotation axis, during working operation. For this purpose, the edge processing roller on the adjustable roller holding device can be adjusted relative to the external surface of the compaction roller between a passive position, or a transport position without contact to the underlying ground, and the edge processing position. The passive position in this case refers to a position in which the edge processing roller does not protrude, in radial direction relative to the traveling rotation axis of the compaction roller, beyond the vertically lower apex of the cross-section of the compaction roller and is thus usually free of contact with the subsoil cover layer. The edge processing position, on the other hand, refers to an adjustment position of the edge processing roller in which it is positioned at least flush with the vertically lower apex of the compaction roller or, preferably, even protrudes, to a defined extent, vertically downward beyond the external surface of the compaction roller, in particular with respect to the lower apex of the external surface of the compaction roller. It is important to note that there is usually not one single edge processing position, but that the edge processing position is variable within a defined range, for example to allow adaptation measures to the respective thickness of the subsoil cover layer. In the edge processing position, the edge processing roller thus cuts into the subsoil cover layer and/or presses it in the side region to obtain a straight and evenly shaped subsoil cover layer edge.

To relieve the driver of such a ground compaction apparatus from having to take manual action every time the adjustment position of the cover edge processing roller is changed between the passive position and the edge processing position, the cover edge processing roller is preferably mounted on the roller holding device, in particular an adjustment arm, such that it is adjustable using an adjustment drive. Such an adjustment drive may be, for example, a hydraulic cylinder piston unit.

Examples of cover edge processing apparatuses are described, for example, in DE 91 11 398 U1, DE 1 939 680 U1, DE 30 20 796 A1, DE 29 27 883 A1 and DE 87 10 179 U1.

Users of such cover edge processing apparatuses sometimes supplement factory-available cover edge processing apparatuses with a plow-type cut material deflector having at least one material guide surface provided to push cut cover material produced during working operation of the cover edge processing apparatus away from the subsoil cover layer in the direction of the traveling rotation axis while passing over the subsoil cover layer. Such a cut material deflector is thus supposed to push the subsoil cover material cut off from the subsoil cover layer laterally away from the subsoil cover layer in order to reduce post-processing measures on the one hand and to facilitate collection of the cut material on the other hand. Such a cut material deflector is described, for example, in DE 91 11 398 U1.

However, the known cut material deflectors have the disadvantage that they require manual adjustment for precise operation, which is perceived by the user as inconvenient and therefore disadvantageous. In addition, this often leads to inadequate work results, so that there is an overall need for optimization here.

Starting from the known prior art, the present invention thus consists in a ground compaction apparatus of the generic type with a cut material deflector which, compared to the known solutions, facilitates operation, in particular also with regard to matching to different subsoil cover layer thicknesses.

SUMMARY OF THE INVENTION

A ground compaction apparatus of the present generic type for compacting a subsoil cover layer has at least one compaction roller which is mounted on a support structure of the ground compaction apparatus for rotation about a horizontal traveling rotation axis extending transversely to a working direction and which comprises a cylindrical external surface rolling on the underlying ground during compaction operation. Via the rolling movement, the ground compaction apparatus contacts the underlying ground to be compacted. This can be done statically or dynamically with the help of vibration exciters which are known per se. The ground compaction apparatus further comprises a cover edge processing apparatus arranged on the support structure. The cover edge processing apparatus is used to process, such as cut and/or press, the cover edge as the ground compaction apparatus passes over the subsoil cover layer. For this purpose, the cover edge processing apparatus comprises, in a manner known per se, an edge processing roller, an adjustable roller holding device, in particular an adjustment arm, and an adjustment drive, the edge processing roller being mounted on the adjustable roller holding device for rotation about a roller rotation axis. The edge processing roller is usually not driven and freely rotatable on the roller holding device. It may have a central bearing axis as well as a processing surface running around the bearing axis, in particular at an angle in the radial direction. The adjustable roller holding device is configured such that it is mounted on the support structure such that, driven by the adjustment drive, it is adjustable from a passive position to an edge processing position relative to the external surface of the compaction roller together with the edge processing roller. For this purpose, the adjustable roller holding device may, in particular, be an adjustment arm and/or adjustment lever which is mounted on the support structure on one side so as to be adjustable relative to the latter and, spaced apart from this mounting point, has a bearing for the edge processing roller. Generally, the type of adjusting movement between the passive position and the edge processing position may vary. However, it is possible the adjustment arm can be swiveled relative to the support structure about a swivel axis between the passive position and an edge processing position. In particular, the swivel axis may run parallel to the traveling rotation axis of the compaction roller.

Another generic element of the ground compaction apparatus according to the present invention is the cut material deflector, the function of which is to push the cut subsoil cover layer material separated from the subsoil cover layer further to the side and away from the subsoil cover layer to facilitate subsequent collection or the like. For this, the cut material deflector comprises at least one material guide surface provided to push cut cover material produced during working operation of the cover edge processing apparatus away from the subsoil cover layer in the direction of the traveling rotation axis while passing over the subsoil cover layer. The material guide surface is thus functionally comparable to a plow element and thus comprises a surface that is at least partially inclined relative to the traveling rotation axis and pushes the cut material from the edge of the subsoil cover layer to the side during passage of the ground compaction apparatus in the working direction.

According to one embodiment, the cut material deflector is not positioned on, for example, the support structure of the ground compaction apparatus in a statically fixed manner or exclusively manually adjustable, but is mounted on the cover edge processing apparatus by a mounting device. Functionally, an adjustment of the cover edge processing apparatus relative to the support structure thus also causes a change in the relative position of the cut material deflector relative to the support structure. However, the mounting device of the cut material deflector on the cover edge processing apparatus is configured, beyond fixed mounting, in such a way that the relative position of the cut material deflector or of the at least one material guide surface of the cut material deflector with respect to the cover edge processing apparatus and, in particular, the roller holding device can be changed, in particular automatically. Automatic is to be understood in such a way that no separate manual adjustment by the operator is required for this, but the adjustment is performed based on other factors. This makes it possible to achieve the relative position of the cut material deflector without individual manual adjustment by the operator and thus to adapt it automatically in an optimized manner to the current operating situation, in particular in the edge processing position of the edge processing roller. The relative position of the cut material deflector is adapted, in particular, such that the side of the cut material deflector, and in particular of the material guide surface, facing the ground is at the same height, for example in the same horizontal plane, as the lower apex of the edge processing roller in the edge processing position of the edge processing roller. The lower apex of the edge processing roller is understood to be the vertically lowest point of the edge processing roller. This position of the cut material deflector or the material guide surface is also referred to as the material guiding position.

With regard to the specific configuration of the automatic adjustment, there are various possible options. On the one hand, it is possible that the mounting device for mounting the cut material deflector is configured such that it adjusts the relative position of the at least one material guide surface with respect to the adjustable roller holding device depending on the adjustment position of the adjustable roller holding device relative to the support structure. This embodiment may thus comprise a coupling means which, acting in a mechanism-like manner, converts a change in position of the roller holding device into an adjusting movement of the material guide surface of the cut material deflector relative to the roller holding device. The adjusting movement of the material guide surface of the cut material deflector relative to the roller holding device is preferably positively coupled. For this purpose, for example, suitable guide mechanisms may be used which enable a corresponding positive coupling of the mounting device of the cut material deflector and the adjustable roller holding device, for example by forming a linkage mechanism or the like.

Additionally or alternatively, the mounting device may also be configured such that it adjusts the relative position of the at least one material guide surface with respect to the adjustable roller holding device depending on gravity or weight. For this purpose, the mounting device of the cut material deflector may, for example, be mounted on the cover edge processing apparatus in such a way that the weight of the cut material deflector is sufficient to lower the cut material deflector and, in particular, the material guide surface vertically downward until the cut material deflector and, in particular, the material guide surface rest on the underlying ground. For this purpose, for example, a rotationally soft mounting may be provided between the cut material deflector and the cover edge processing apparatus. The cut material deflector, or the material guide surface, is thus carried along floating on the underlying ground. The underlying ground may be, for example, a cover layer or the subsoil or ground beneath the cover layer. For example, it may be an asphalt layer and/or the subsoil beneath the asphalt layer. This embodiment is particularly simple and cost-effective to manufacture.

Additionally or alternatively, according to another embodiment of the present invention, the mounting device may further be configured such that it adjusts the relative position of the at least one material guide surface with respect to the adjustable roller holding device through interaction with an underlying ground. For example, the cut material deflector or the material guide surface may be pressed vertically upward against their own weight due to contact with the underlying ground. The mounting device is then specially configured to allow and thus enable such movements of the cut material deflector or the material guide surface induced by contact with the underlying ground.

Generally, the cut material deflector may be arranged as an additional component on the support structure of the ground compaction apparatus or on the machine frame of a ground compaction machine, for example asphalt roller, comprising the ground compaction apparatus. However, in order to be able to better control, in particular, the relative position of the cut material deflector with respect to the roller holding device or the edge processing roller, it is possible that the cut material deflector is adjustably mounted directly on the cover edge processing apparatus. The cut material deflector may therefore be considered part of the cover edge processing apparatus. In particular, the cut material deflector moves together with the cover edge processing apparatus when the latter is adjusted in position, for example relative to the support structure. According to one embodiment of the present invention, the relative position of the cut material deflector or the material guide surface with respect to the adjustable roller holding device of the cover edge processing apparatus is automatically changed during such a position adjustment of the cover edge processing apparatus. Such a coupling of the motion sequences is obtained particularly easily if the cut material deflector is adjustably mounted directly on the cover edge processing apparatus and is therefore moved along with the latter.

According to one embodiment of the present invention, the mounting device of the cut material deflector comprises a mounting arm. On the one hand, the mounting arm is connected to the cover edge processing apparatus. On the other hand, the mounting arm also carries the material guide surface. The mounting arm is preferably configured to be rotatable about an adjustment axis relative to the adjustable roller holding device of the edge processing device. The mounting arm is thus configured as a swivel arm that can be swiveled about its connection point on the cover edge processing apparatus. Accordingly, the material guide surface can likewise be swiveled about the connection point of the mounting arm on the cover edge processing apparatus. Additionally or alternatively, the mounting arm may also be configured to be displaceable along an adjustment curve relative to the adjustable roller holding device of the edge processing apparatus, in particular linearly. The corresponding adjustment curve of the mounting arm is implemented, for example, by a link guide. The frame including the link guide may be attached, for example, to the cover edge processing apparatus. Both possibilities of movement of the mounting arm, swiveling and displacement, enable the automatic change of the relative position of the material guide surface of the cut material deflector with respect to the roller holding device according to the present invention.

The swiveling mounting arm of the mounting device may generally be swivel-mounted at any point on the cover edge processing apparatus. According to one embodiment of the present invention, a particularly simple and reliable setting of a desired relative position of the material guide surface with respect to the edge processing roller or to the roller holding device is achieved by the mounting arm of the mounting device of the cut material deflector being mounted coaxially to the roller rotation axis of the edge processing roller for rotation relative to the adjustable roller holding device. The connection point of the mounting arm on the cover edge processing apparatus is thus selected such that the adjustment axis about which the mounting arm can be swiveled is identical to the roller rotation axis about which the edge processing roller is rotatably mounted during working operation. This is a simple way of ensuring that the material guide surface is at the same distance from the edge processing roller in every working position, so that optimum working results can be achieved at all times.

In one embodiment, the edge processing roller is arranged in front of the mounting device, in particular the mounting arm, as seen from the outside of the machine along the roller rotation axis. In other words, the edge processing roller is arranged further out on the machine transverse to the working direction than the mounting device. The material guide surface, on the other hand, also protrudes outward beyond the edge processing roller. This ensures that cut material cut by the edge processing roller is actually captured by the material guide surface and moved away from the subsoil cover layer. Furthermore, it is possible that the mounting device, in particular the mounting arm, is arranged along the roller rotation axis exclusively behind the edge processing roller. Only the material guide surface protrudes outward, past the edge processing roller and further outward. In this manner, the machine width in the region of the edge processing roller is not increased by the mounting device. According to a particularly space-saving embodiment, the elements edge processing roller, mounting device, in particular mounting arm of the mounting device, and adjustable roller holding devices of the cover edge processing apparatus are arranged one after the other as seen from the outside of the machine along the roller rotation axis. In other words, the mounting device, in particular the mounting arm of the mounting device, is to be arranged at least partially, as seen in the direction of the roller rotation axis, between the edge processing roller and the adjustable roller holding device of the cover edge processing apparatus. The roller rotation axis extends transversely to the working direction. Due to the corresponding arrangement, the mounting arm can be made particularly short, and yet the material guide surface is arranged in the immediate vicinity of the edge processing roller, which enables reliable working operation.

According to another alternative embodiment of the present invention, the mounting device, in particular the mounting arm of the mounting device, is arranged on the side of the edge processing roller facing away from the compaction roller, as viewed in the direction of the roller rotation axis. In this case, in other words, the mounting device, in particular the mounting arm, is arranged in front of the edge processing roller as seen from the outside of the machine along the roller rotation axis. Thus, the mounting device is arranged further out on the machine transversely to the working direction than the edge processing roller. Again, however, the material guide surface protrudes outward beyond both the edge processing roller and the mounting device. In this embodiment, the elements mounting device, in particular mounting arm of the mounting device, edge processing roller and adjustable roller holding devices of the cover edge processing apparatus are thus arranged one after the other as seen from the outside of the machine along the roller rotation axis. In other words, viewed in the direction of the roller rotation axis, the edge processing roller is located between the mounting device, in particular the mounting arm of the mounting device, and the adjustable roller holding device. In particular, in this embodiment, the mounting arm is arranged or mounted on a support shaft passing through the edge processing roller to the side of the edge processing roller facing away from the compaction roller. This results in a particularly simple structure which keeps manufacturing costs low.

As already described above, the edge processing roller is rotatably attached to the cover edge processing apparatus and, in particular, to the roller holding device. The non-driven edge processing roller rolls in working operation when contacting the ground, rotating about a roller rotation axis formed by a support shaft. To connect the cut material deflector, it is now preferred that the mounting device, in particular the mounting arm of the mounting device, is mounted on the cover edge processing apparatus in such a way that it revolves around a support shaft of the edge processing roller, in particular in the radial direction with respect to the roller rotation axis. The mounting device or the mounting arm thus engage around the support shaft of the edge processing roller, which contributes to a reliable attachment of the cut material deflector.

Generally, as described above, the mounting device may hold the cut material deflector and, in particular, the material guide surface floating on the underlying ground, for example, by its gravitational force. However, vibrations or unevenness may cause the material guide surface to bounce on the ground and therefore partially fail to capture cut material. Therefore, according to one embodiment of the present invention, the mounting device has a means, in particular acting at least partially downward in the vertical direction, for applying actuating force to the cut material deflector and, in particular, to the material guide surface. The means for applying the actuating force thus actively presses the cut material deflector, and, in particular, the material guide surface, vertically downward onto the underlying ground. The cut material deflector and, in particular, the material guide surface are thus preloaded in vertical downward direction, i.e., onto the underlying ground. The material guide surface of the cut material deflector therefore always runs closely along the underlying ground, even if the underlying ground is uneven or the machine is vibrating, and therefore conveys the cut material outwardly away from the subsoil cover layer in a particularly reliable manner. In order to keep wear of the material guide surface as minimal as possible, the latter may have a roller or a skid which is arranged on the material guide surface in such a way that, on the one hand, it contacts the underlying ground and, in particular, is also pressed onto the underlying ground by the means for applying actuating force, and at the same time keeps the material guide surface slightly spaced from the ground, for example by a few millimeters.

Generally, the means for applying actuating force to the cut material deflector may vary in configuration, as long as the cut material deflector and, in particular, the material guide surface are pressed vertically downward, i.e., onto the ground. For example, it is possible that the means for applying actuating force be located between the mounting arm and the adjustable roller holding device. For example, the means for applying actuating force may be arranged between the mounting device or the mounting arm and a support shaft arranged on the adjustable roller holding device and passing through the edge processing roller, in particular along the roller rotation axis. In other words, the support shaft passes through the edge processing roller to the side of the edge processing roller opposite the compaction roller. It may, for example, be configured for co-rotation with the roller holding device. The means for applying actuating force therefore uses, for example, the adjustable roller holding device as a counter bearing and, from there, presses or pulls the mounting arm of the mounting device of the cut material deflector vertically downward. The actuating force applied to the mounting arm therefore causes the mounting arm to rotate about the adjustment axis, which leads to a lowering of the material guide surface until the latter rests on the underlying ground. In particular, the means for applying actuating force may also comprise an elastic actuation member. According to one embodiment of the present invention, the means for applying actuating force is a coil spring, a torsion spring or a gas pressure spring. These may be arranged particularly easily between the adjustable roller holding device and the mounting arm and apply a force to the mounting arm accordingly. In addition, such springs are particularly cheap and reliable.

Generally, the material guide surface or the cut material deflector can always be adjusted to such an extent that the material guide surface rests with its bottom side on the underlying ground and is carried along floating on the latter. However, this may lead to increased wear on the material guide surface. According to an advantageous modification of the present invention, an adjustment path limiting device is provided which limits the adjustment path of the cut material deflector relative to the edge processing roller and/or relative to the compaction roller. Said device may be, for example, a stop that positively limits the movement of the cut material deflector and/or the material guide surface, or similar elements. The adjustment path limiting device may be arranged on the roller holding device, for example. It may be, for example, a mechanical stop which determines the material guiding position of the material guide surface depending on the position of the roller holding device. Due to the stop being arranged on the roller holding device, the material guiding position of the material guide surface can always be arranged such that the vertically lowest point of the material guide surface coincides with the vertically lowest point of the edge processing roll. The adjustment travel limiting device may, for example, also be an oblong hole into which the mounting device, in particular the mounting arm, protrudes at least partially. For this purpose, for example, a projection may be provided on the mounting device, which is guided in the oblong hole. The mechanical stop may then be formed by the end of the oblong hole, for example. Additionally or alternatively, the material guiding position of the material guide surface may be configured or selected such that the cut material deflector remains out of contact with the underlying ground during operation. In this embodiment, the adjustment path limiting device may be configured such that the cut material deflector and, in particular, the material guide surface are spaced from the underlying ground in the material guiding position. The material guide surface is therefore guided hovering above the ground and is therefore subject to considerably less wear.

In one embodiment of the present invention described above, the mounting arm or mounting device is located further out along the roller rotation axis than the edge processing roller itself. For structural reasons, the mounting arm or mounting device may also be spaced from the edge processing roller along the roller rotation axis. Nevertheless, the material guide surface should, on the one hand, start as flush as possible with the edge processing roller and protrude outward in the direction of the roller rotation axis to beyond the mounting device. For this purpose, it is possible that the material guide surface extends along the roller rotation axis on both sides away from the mounting device, in particular the mounting arm of the mounting device, especially toward and away from the edge processing roller. Viewed from the mounting device, the material guide surface thus extends along the roller rotation axis in both directions, both toward the edge processing roller and outward away from it and the center of the machine. Along the roller rotation axis, the material guide surface thus extends from the edge processing roller to the mounting device and protrudes beyond the latter toward the outside of the machine. In this manner, even with a mounting device located outside the edge processing roller, it is ensured that the cut material is reliably removed from the remaining edge by the material guide surface.

As described above, the mounting device and, in particular, the mounting arm may alternatively be arranged behind the edge processing roller as seen from the outside along the roller rotation axis. According to one embodiment of the present invention, in order to have the material guide surface start flush with the external side of the edge processing roller, the mounting device is provided, between the mounting arm and the material guide surface, with a width bridging member extending in the direction parallel to the roller rotation axis and having an extension in the direction of the roller rotation axis corresponding to a range of 80% to 120% of the axial extension of the edge processing roller in the direction of the roller rotation axis. The extension of the width bridging member along the roller rotation axis thus corresponds, for example, to 80%, 90%, 100%, 110% or 120% of the thickness of the edge processing roller. The thickness of the edge processing roller is likewise defined in the direction of the roller rotation axis. The width bridging member is preferably arranged between the mounting arm and the material guide surface, spacing them apart. In this manner, the mounting arm can be arranged in a space-saving manner behind the edge processing roller, as viewed from the outside, and still support the material guide surface, which protrudes outward beyond the edge processing roller.

The material guide surface according to the present invention conveys the cut material away from the subsoil cover layer. The cut material then lies on the ground at a distance from the subsoil cover layer, so that the cut material can be collected, for example, by a wheel loader without the risk of the wheel loader damaging the subsoil cover layer with its bucket. Nevertheless, another step and another machine are necessary to collect the cut material. Therefore, in order to further reduce the operating costs and the necessary work, it is possible that the ground compaction apparatus is also configured to collect the cut material. For this purpose, it is possible that the ground compaction apparatus has a collecting container arranged behind the material guide surface in the working direction, comprising a receiving opening and a material collecting region, the receiving opening being positioned such that material guided by the material guide surface in the material guiding position is guided into the receiving opening in the case of continued movement in the working direction. The material guide surface directs the cut material both away from the subsoil cover layer and into the collecting container. The collecting container may, for example, also have a support frame and, for example, rollers or wheels with which the collecting container can be guided on the underlying ground. However, the collecting container may also be configured such that it can be guided spaced from the underlying ground and hovering above the latter. In this case, the collecting container is attached, for example, to the support structure of the ground compaction apparatus. Although the collecting container must be emptied regularly during operation, the collection of the cut material does not need to be carried out in a second step by another machine, thus saving costs.

The present invention also relates to an asphalt roller, in particular an articulated-steered or pivot-steered tandem roller or a rubber-tired roller, with a ground compaction apparatus according to the preceding explanations. The aforementioned features, effects and advantages of the ground compaction apparatus correspondingly also apply to the asphalt roller according to the present invention. The same applies to the method according to the present invention described below.

The present invention also relates to a method for operating a ground compaction apparatus, in particular a ground compaction apparatus according to the above statements, with a compaction roller rotatably mounted on a support structure and a cover edge processing apparatus mounted on the support structure, comprising an edge processing roller, an adjustment arm and an adjustment drive. As already described, the edge processing roller can be adjusted from a passive position into an edge processing position relative to the external surface of the compaction roller by means of an adjustment drive. The method according to the present invention comprises at least the following steps: adjusting the cover edge processing apparatus from the passive position into the edge processing position relative to the external surface of the compaction roller and, simultaneously, automatically adjusting a cut material deflector relative to the cover edge processing apparatus, in particular into the material guiding position. The method according to the present invention is thus characterized in that the cut material deflector and, in particular, its material guide surface is automatically adjusted into the material guiding position, triggered by the adjustment of the edge processing roller into the edge processing position. In particular, both adjustments, i.e. of the edge processing roller and of the cut material deflector, occur simultaneously, in particular coupled or positively coupled. According to the present invention, it is therefore only necessary for the operator to activate the adjustment of the ground compaction apparatus into the working position on a control device. He therefore does not need to adjust the cut material deflector separately from the edge processing roller in a separate work step.

The method according to the present invention may be further modified such that the cut material deflector is adjusted relative to the cover edge processing apparatus depending on an adjustment position of the adjustment arm of the roller holding device, gravity or an interaction of the cut material deflector with the underlying ground. To avoid repetitions, reference is made to the above discussion.

BRIEF DESCRIPTION OF THE DRAWINGS

The present invention will be described in more detail below by reference to the embodiment examples shown in the figures. In the schematic figures.

Like parts or functionally like parts are designated by like reference numerals in the figures. Recurring parts are not designated separately in each figure.

DETAILED DESCRIPTION OF THE INVENTION

Figure 1:
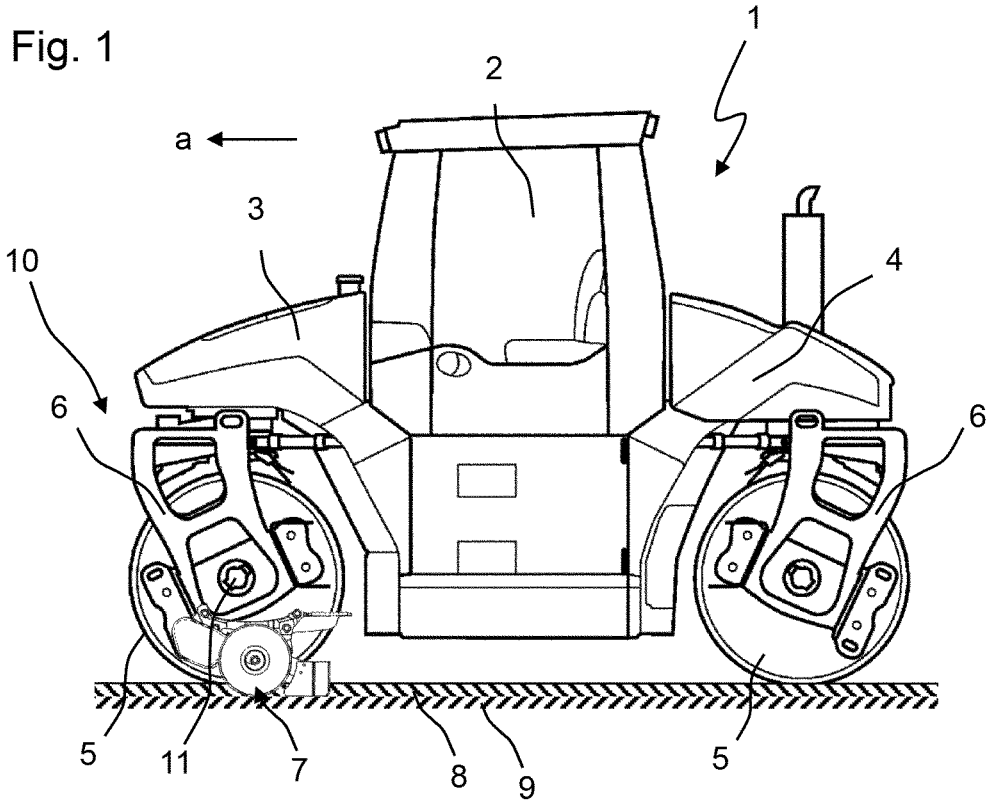
FIG. 1 is a side view of an asphalt roller.

FIG. 1 shows an asphalt roller 1, in this case a tandem roller. The asphalt roller 1 has a machine frame 3 and an operator platform 2. Its traveling gear comprises support structures 6 and compaction rollers 5, in the present case roller drums, mounted on the support structure 6. The compaction rollers 5 are mounted on the machine frame 3 via the support structures 6. Moreover, the asphalt roller 1 has a drive motor 4, for example a diesel combustion engine or an electric motor, which drives the asphalt roller 1. In working operation of the asphalt roller 1, the latter is guided over a ground in or against the working direction a and compacts it by rotating the compaction rollers 5 about a traveling rotation axis 11. The ground comprises, for example, a subsoil 9 and a subsoil cover layer 8 disposed on the subsoil 9. For example, the subsoil layer 8 is an asphalt layer to be compacted by the asphalt roller 1 to form a road. The subsoil 9 is, for example, ground material disposed beneath the asphalt layer. The asphalt roller 1 according to FIG. 1 has a ground compaction apparatus 10 according to the present invention, comprising a support structure 6, a compaction roller 5 and a cover edge processing apparatus 7. In the embodiment example shown, the ground compaction apparatus 10 and, in particular, the cover edge processing apparatus 7 are arranged at the front left of the asphalt roller 1. However, the ground compaction apparatus 10 or the cover edge processing apparatus 7 may just as well be arranged at the front right or rear left or rear right of the asphalt roller 1. Moreover, it is also possible that multiple machine sides each have a ground compaction apparatus 10 with a cover edge processing apparatus 7.

Figure 2:
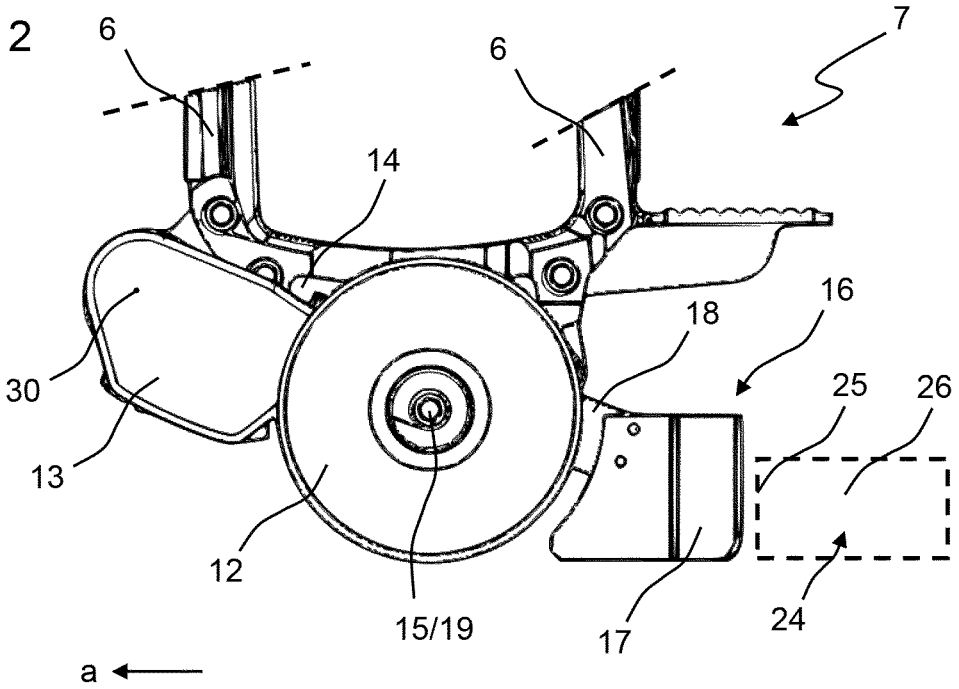
FIG. 2 is an enlarged side view of a cover edge processing apparatus.

The cover edge processing apparatus 7 is shown in FIG. 2 in an enlarged side view from the same perspective as in FIG. 1. The cover edge processing apparatus 7 is attached to the support structure 6 of the compaction roller 5. It has an edge processing roller 12 which is mounted on the support structure 6 via a roller holding device 13, in this case an adjustment arm. In particular, the roller holding device 13 configured as an adjustment arm is mounted on the support structure 6 for rotation about a swivel axis 30. The edge processing roller 12, in turn, is likewise rotatably attached to the roller holding device 13, specifically about a roller rotation axis 15. Moreover, the cover edge processing apparatus 7 has a cut material deflector 16. The cut material deflector 16 is configured to convey cut material separated from the subsoil cover layer 8 by the edge processing roller 12 during operation laterally, i.e. transversely to the working direction a or parallel to the roller rotation axis 15, away from the remaining part of the subsoil cover layer 8. This is to facilitate subsequent removal of the cut material and to reduce the risk of accidentally damaging the remaining subsoil cover layer 8 when removing the cut material. The cut material deflector 16 comprises a mounting device 18, which is in this case configured as a mounting arm, and a material guide surface 17 arranged on the mounting arm or the mounting device 18. If the adjustment arm of the roller holding device 13 is swiveled about the swivel axis 30, the position of the edge processing roller 12 changes in the vertical direction. In particular, the cover edge processing apparatus 7, and, in particular, the edge processing roller 12, is adjusted by swiveling the roller holding device 13 between a passive position in which the edge processing roller 12 is not in contact with the ground and an edge processing position in which the edge processing roller 12 either cuts off or presses against a part of the subsoil cover layer 8. In order to drive this adjusting movement of the roller holding device 13 or of the adjustment arm, an adjustment drive 14 is provided which in the embodiment example shown is a hydraulic cylinder, in particular a double-acting hydraulic cylinder. The adjustment drive 14 thus adjusts the roller holding device 13 between the passive position and the edge processing position.

FIG. 2 also shows a collecting container 24, which has a receiving opening 25 located at the front in the working direction a and a material collecting region 26. The collecting container 24 is configured and arranged on the ground compaction apparatus 10 or the cover edge processing apparatus 7 or the machine frame 3 of the asphalt roller 1 in such a way that cut material conveyed away from the subsoil cover layer 8 by the material guide surface 17 is conveyed through the receiving opening 25 into the material collecting region 26 of the collecting container 24 as the asphalt roller 1 moves forward in the working direction a. For this purpose, the collecting container 24 may have, for example, a ramp or a guide plate configured to guide the cut material into the receiving opening 25. The collecting container 24 is thus configured such that it collects the produced cut material in the same operation as the processing of the subsoil cover layer 8 by the edge processing roller 12. The cut material therefore does not need to be collected in a separate step by a separate machine, such as a wheel loader.

Figure 3:
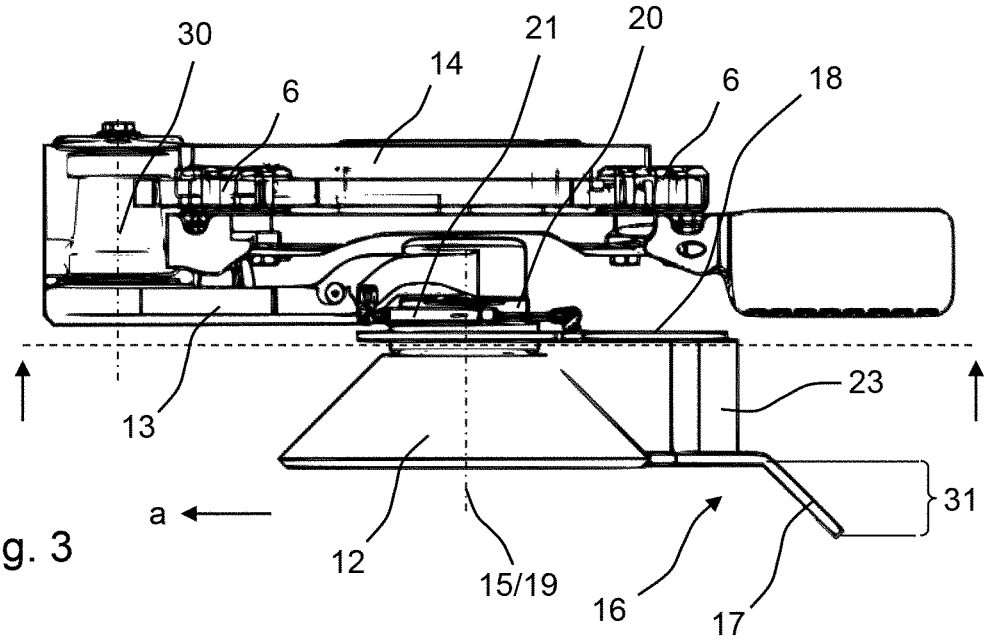
FIG. 3 is a top view of a cover edge processing apparatus.
Figure 4:
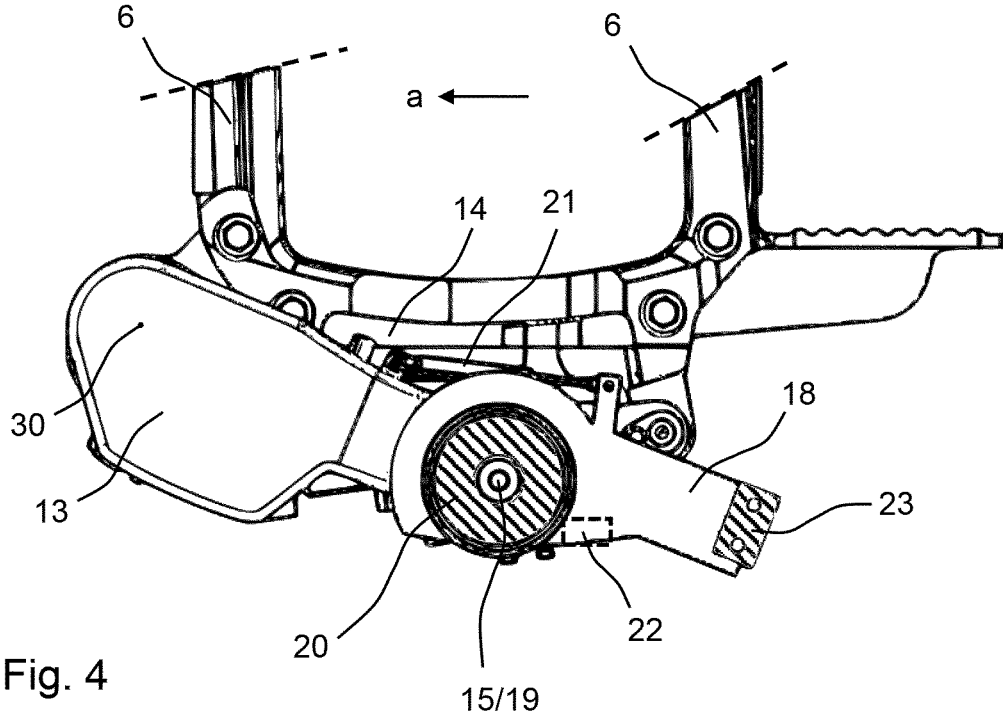
FIG. 4 is a side view of a cover edge processing apparatus without edge processing roller and material guide surface from the perspective indicated by the dashed line with the two arrows in FIG. 3.

The cover edge processing apparatus 7 is shown in a top view in FIG. 3, so that its structure can be seen in more detail. FIG. 3 shows that the edge processing roller 12 is rotatably mounted on the roller holding device 13, or the adjustment arm, via a support shaft 20. In addition, the mounting device 18 or the mounting arm is also rotatably mounted on the support shaft 20. A synopsis with FIG. 4 shows that the mounting device 18 or the mounting arm at least partially or almost completely engages around the support shaft 20 in the embodiment example shown. The mounting device 18 or the mounting arm can therefore also be rotated about the support shaft 20, in particular about an adjustment axis 19 which corresponds to the roller rotation axis 15. Moreover, an actuating force which is directed, in particular, vertically downward is applied to the mounting arm or the mounting device 18 by means for applying actuating force 21. In the embodiment example shown, the means for applying actuating force 21 is configured as a gas pressure spring and is arranged between the mounting device 18 or the mounting arm and the roller holding device 13 or the adjustment arm. In particular, the means for applying actuating force 21 causes the mounting device 18 or the mounting arm to rotate about the adjustment axis 19 in such a way that the cut material deflector 16 or the material guide surface 17 moves downward in the vertical direction. The means for applying actuating force 21 presses the material guide surface 17 onto the underlying ground, for example the subsoil cover layer 8 or the subsoil 9. Pressing the material guide surface 17 onto the underlying ground prevents the cut material deflector 16 from bouncing, thereby ensuring reliable conveyance of the cut material away from the subsoil cover layer 8.

FIGS. 3 and 4 also show a width bridging member 23 of the cut material deflector 16, which is arranged between the mounting device 18 or the mounting arm and the material guide surface 17. The width bridging piece 23 spaces the mounting device 18 from the material guide surface 17, and, in particular, over the entire width of the edge processing roller 12 in the direction of the roller rotation axis 15 or the adjustment axis 19. In particular, FIG. 3 shows that the entire mounting device 18 including the width bridging member 23 is arranged at the same level and/or behind the edge processing roller 12 along the roller rotation axis 15 or the adjustment axis 19 as seen from the outside of the machine. In other words, the mounting device 18 and the width bridging member 23 do not protrude outward beyond the edge processing roller 12 in the direction of the roller rotation axis 15 or the adjustment axis 19. Only the material guide surface 17 protrudes away from the machine beyond the edge processing roller 12 in the direction of the roller rotation axis 15 or the adjustment axis 19. In particular, the material guide surface 17 protrudes beyond the edge processing roller 12 along the roller rotation axis 15 or adjustment axis 19 with a material guide path 31. The material guide path 31 is defined by the material guide surface 17 and describes the path along which cut material is conveyed by the material guide surface 17. The material guide path 31 extends outward beyond the edge processing roller 12 in the direction of the roller rotation axis 15 or the adjustment axis 19, in particular, for example, by 5 cm to 15 cm, for example by 5 cm to 10 cm, and preferably by 10 cm.

In the material guiding position, the material guide surface 17 is located behind the edge processing roller 12 in the working direction a in such a way that it conveys the cut material from the edge processing roller 12 to the outside transversely to the working direction a. For this purpose, the bottom edge of the material guide surface 17 may be pressed onto the underlying ground in a floating manner, for example by the gas pressure spring constituting the means for applying actuating force 21. The material guide surface 17 is then carried along with continuous ground contact. However, in order to avoid wear on the material guide surface 17, it is also possible to carry it slightly spaced from the underlying ground, i.e. hovering above the underlying ground. An adjustment path limiting device 22 may be provided for this purpose, as shown, for example, in FIG. 4. In the embodiment example shown, the adjustment path limiting device 22 is a mechanical stop arranged on the roller holding device 13 or the adjustment arm. Said stop may, for example, also be part of an oblong hole into which the mounting device 18 or the mounting arm projects at least partially and which limits the adjustment movement of the edge processing roller 12. In particular, through a positive stop with the mounting device 18 or the mounting arm, the adjustment path limiting device 22 prevents an adjustment of the material guide surface 17 in the vertical direction so far downwards that the material guide surface 17 comes into contact with the ground. The adjustment path limiting device 22 thus stops the rotational movement of the mounting device 18 or the mounting arm about the adjustment axis 19 before the material guide surface 17 contacts the underlying ground. This results in a spacing and a hovering support of the material guide surface 17 above the underlying ground. The corresponding spacing may be a few millimeters, so that increased wear on the material guide surface 17 is prevented, but at the same time a reliable collection or conveyance of the cut material to the side is ensured.

Figure 5:
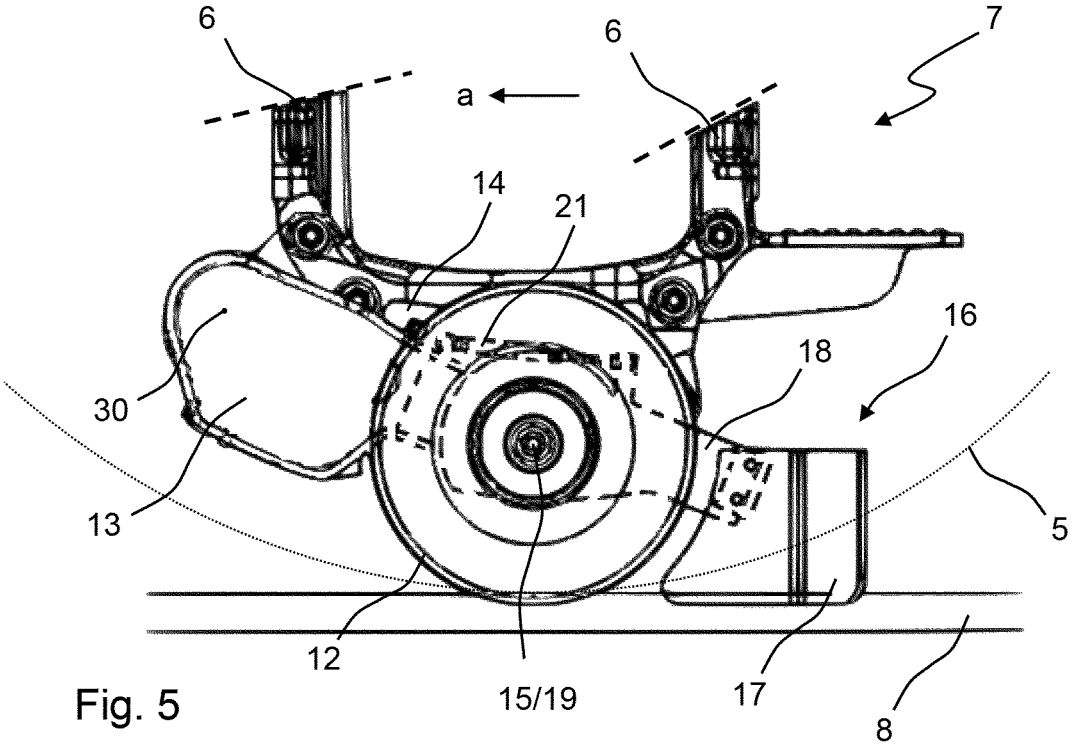
FIG. 5 is a side view of a cover edge processing apparatus in a working position partially penetrating the subsoil cover layer.
Figure 6:
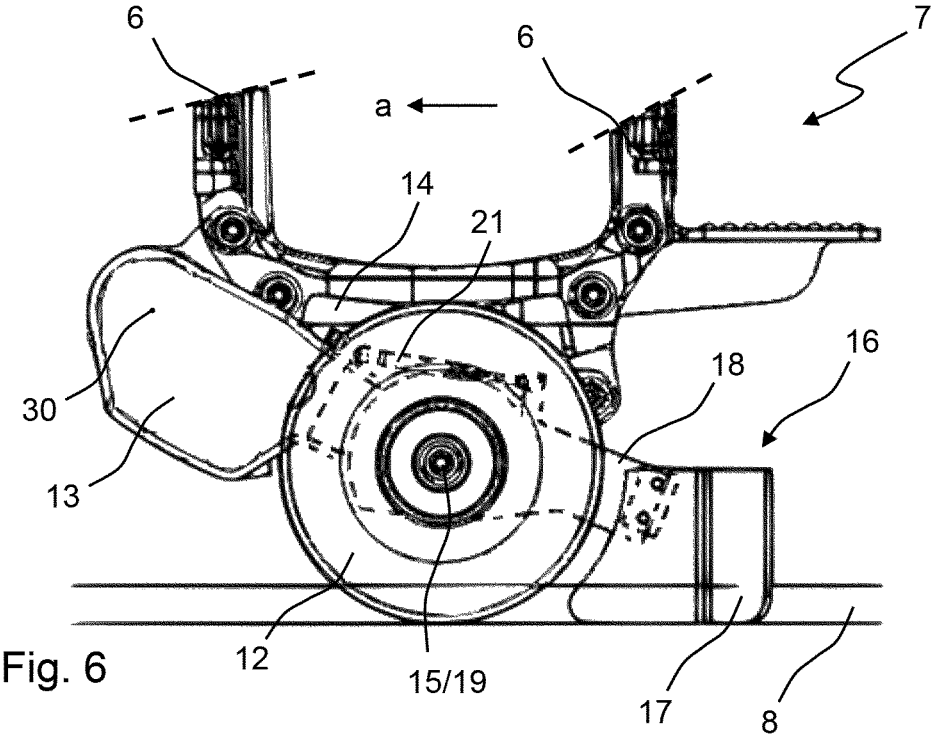
FIG. 6 is a side view of a cover edge processing apparatus in a working position fully penetrating the subsoil cover layer.

One aspect of the present invention is that the cut material deflector 16 is also automatically adjusted when the edge processing roller 12 is adjusted via the roller holding device 13. This can be seen, for example, in FIGS. 5 and 6. The two figures show the cover edge processing apparatus 7 in two different edge processing positions. In particular, FIG. 5 shows an edge processing position in which the edge processing roller 12 does not completely penetrate the subsoil cover layer 8, for example an asphalt layer. In the situation according to FIG. 6, on the other hand, the edge processing roller 12 penetrates the subsoil cover layer 8 completely. The necessary movement of the edge processing roller 12 is effected by swiveling the roller holding device 13 about the swivel axis 30, driven by the adjustment drive 14. This allows the vertical position of the edge processing roller 12 to be adjusted. To ensure that the cut material deflector 16 and, in particular, the material guide surface 17 have the correct material guiding position in both positions of the edge processing roller 12, the cut material deflector 16 or the material guide surface 17 is adjusted automatically and simultaneously to an adjustment of the edge processing roller 12. In the embodiment example shown, this is achieved, on the one hand, by an interaction of the material guide surface 17 with the underlying ground and, on the other hand, by the means for applying actuating force 21, which is configured as a gas pressure spring. If, for example, the edge processing roller 12 is moved from the vertically higher position according to FIG. 5 to the vertically lower edge processing position according to FIG. 6, the material guide surface 17 is pressed against the underlying ground. As a result, the material guide surface 17 is pressed vertically upward by the underlying ground, and the mounting device 18 or the mounting arm rotates about the adjustment axis 19. At the same time, however, the gas pressure spring presses the material guide surface 17 downward, ensuring that the material guide surface 17 always remains in contact with the underlying ground and is not lifted off the latter. In this manner, the cut material is always reliably captured by the material guide surface 17. According to the present invention, the material guide surface 17 is therefore always automatically brought into the correct material guiding position in its vertical height, triggered by the adjustment of the edge processing roller 12. Additional manual adjustment of the cut material deflector 16 by an operator is not necessary.

Figure 7:
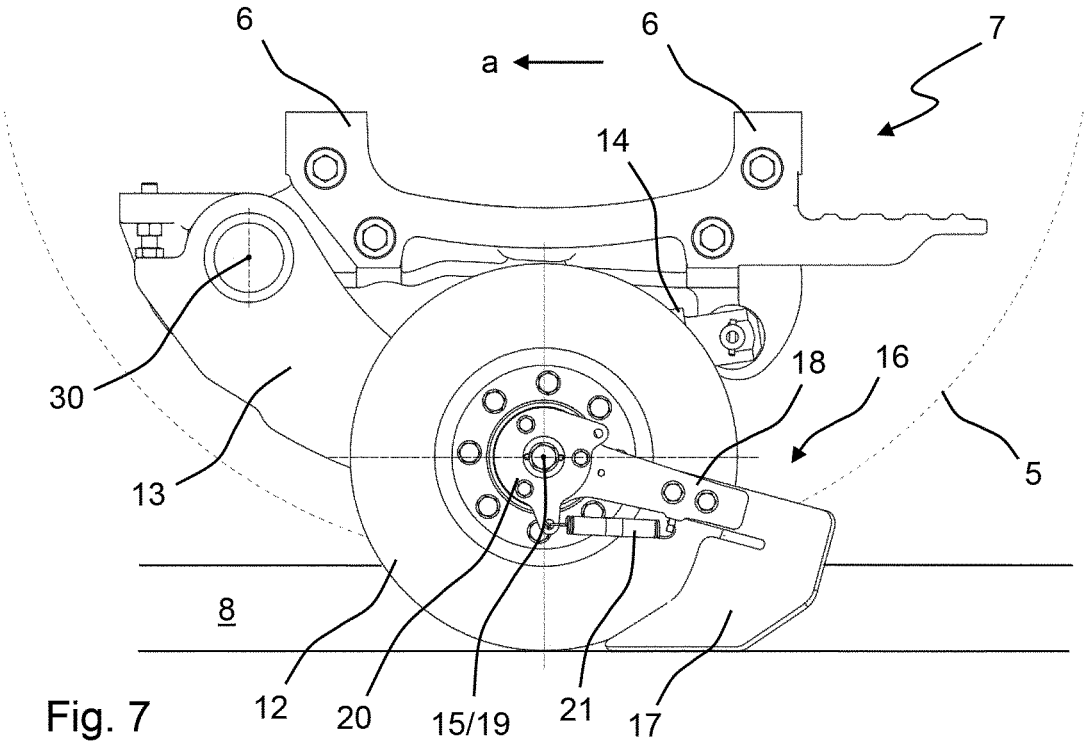
FIG. 7 is a side view of an alternative embodiment of a cover edge processing apparatus in a working position fully penetrating the subsoil cover layer.
Figure 8:
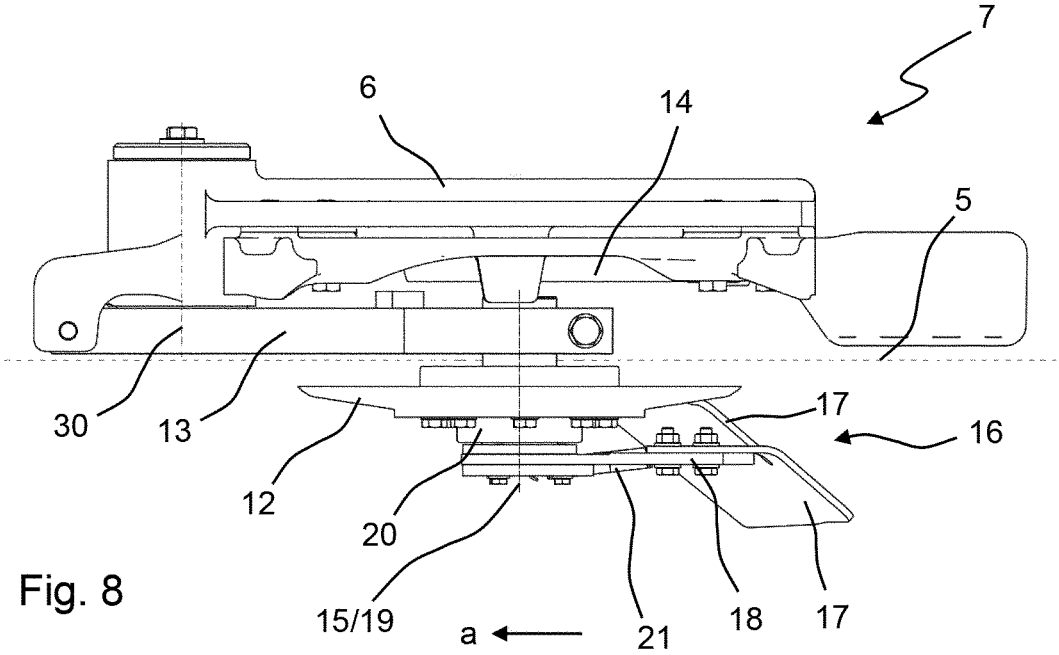
FIG. 8 is a top view of the cover edge processing apparatus according to FIG. 7.

FIGS. 7 and 8 show an alternative embodiment of a cover edge processing apparatus 7. In particular, FIG. 7 shows a side view of the cover edge processing apparatus 7 in a working position fully penetrating the subsoil cover layer 8. FIG. 8 shows a top view of the cover edge processing apparatus 7. The cover edge processing apparatus 7 largely corresponds to the preceding embodiments, which are therefore referred to in order to avoid repetition. In contrast to the embodiment described so far, the mounting device 18, in particular its mounting arm, is arranged along the roller rotation axis 15 further out on the machine than the edge processing roller 12. In other words, the edge processing roller 12 is arranged between the roller holding device 13 and the mounting device 18. Moreover, a means for applying actuating force 21 configured as a tension spring or coil spring may be present which is arranged between the mounting device 18, in particular its mounting arm, and the support shaft 20 penetrating the edge processing roller 12. The support shaft 20, in turn, may be connected to the roller holding device 13. The coil spring applies a force to the mounting device 18 which triggers a rotation about the roller rotation axis 15, which in turn causes the material guide surface 17 to be pressed onto the subsoil cover layer 8. As can be seen, in particular, from FIG. 8, the material guide surface 17 may be configured such that it protrudes beyond the mounting device 18 on both sides along the roller rotation axis 15, such that the material guide surface 17 extends away from the center of the machine from the edge processing roller 12 to the mounting device 18 and beyond the latter. In this manner, cut material is reliably removed in the direction away from the edge being processed.

Figure 9:
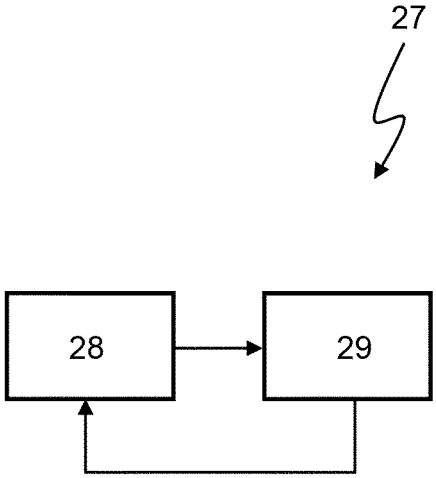
FIG. 9 is a flow chart of the method.

FIG. 9 shows a flow chart of the method 27 according to the present invention. The method 27 comprises adjusting 28 the cover edge processing apparatus 7 relative to the external surface of the compaction roller 5 from the passive position into the edge processing position. Alternatively, said adjusting 28 could also be performed between two different edge processing positions, as shown, for example, in FIGS. 5 and 6. In one embodiment of the present invention, automatic adjusting 29 of the cut material deflector 16 relative to the cover edge processing apparatus 7 and, in particular, relative to the roller holding device 13 is performed simultaneously with said adjusting 28 of the cover edge processing apparatus 7. As already described above, according to the present invention, the cut material deflector 16 is automatically adjusted to the correct material guiding position of the material guide surface 17 for the respective edge processing position of the edge processing roller 12. Overall, therefore, the present invention provides a ground compaction apparatus 10 that is particularly easy to operate, has a simple structure, and allows an operator to move the edge processing roller 12 into the correct position with one push of a button while ensuring, without any further steps for the operator, that the resulting cut material is removed from the subsoil cover layer 8 by the cut material deflector 16 in such a way that the cut material can be collected more easily and quickly.

What is claimed is:

1. A ground compaction apparatus for compacting a subsoil cover layer, comprising:

at least one compaction roller which is mounted on a support structure of the ground compaction apparatus for rotation about a horizontal traveling rotation axis extending transversely to a working direction (a), and which comprises a cylindrical external surface rolling on the underlying ground during compaction operation;

a cover edge processing apparatus arranged on the support structure, comprising an edge processing roller, an adjustable roller holding device comprising an adjustment arm, and an adjustment drive, wherein the edge processing roller is mounted on the adjustable roller holding device for rotation about a roller rotation axis, and wherein the adjustable roller holding device is mounted on the support structure such that, driven by the adjustment drive, it can be adjusted together with the edge processing roller from a passive position into an edge processing position relative to the external surface of the compaction roller; and a cut material deflector with at least one material guide surface provided to push cut cover material produced during working operation of the cover edge processing apparatus away from the subsoil cover layer in a direction of the traveling rotation axis while passing over the subsoil cover layer, wherein the cut material deflector is mounted on the cover edge processing apparatus with the aid of a mounting device, the mounting device being configured such that the relative position of the at least one material guide surface of the cut material deflector with respect to the adjustable roller holding device of the cover edge processing apparatus can be changed automatically.

2. The ground compaction apparatus according to claim 1, wherein the mounting device for mounting the cut material deflector on the cover edge processing apparatus has at least one of the following features:

the mounting device is configured such that the mounting device adjusts the relative position of the at least one material guide surface with respect to the adjustable roller holding device depending on the adjustment position of the adjustable roller holding device with respect to the support structure;

the mounting device is configured such that the mounting device adjusts the relative position of the at least one material guide surface with respect to the adjustable roller holding device depending on gravity; and the mounting device is configured such that the mounting device adjusts the relative position of the at least one material guide surface with respect to the adjustable roller holding device through interaction with an underlying ground.

3. The ground compaction apparatus according to claim 1, wherein the cut material deflector is adjustably mounted directly on the cover edge processing apparatus.

4. The ground compaction apparatus according to claim 1, wherein the mounting arm of the mounting device is arranged at least partially, as seen in the direction of the roller rotation axis, between the edge processing roller and the adjustable roller holding device of the cover edge processing apparatus or that the mounting arm of the mounting device is arranged, as seen in the direction of the roller rotation axis, on the side of the edge processing roller facing away from the compaction roller.

5. The ground compaction apparatus according to claim 1, wherein the mounting arm of the mounting device is mounted on the cover edge processing apparatus such that the mounting arm revolves around a support shaft of the edge processing roller, in the radial direction with respect to the roller rotation axis.

6. The ground compaction apparatus according to claim 1, wherein the mounting device has a means, acting at least partially downward in the vertical direction, for applying actuating force to the cut material deflector.

7. The ground compaction apparatus according to claim 1, wherein the means for applying actuating force to the cut material deflector has at least one of the following features:

the means is arranged between the mounting arm and the adjustable roller holding device;

the means is arranged between the mounting arm and the support shaft arranged on the roller holding device, the support shaft being guided through the edge processing roller to the side of the edge processing roller facing away from the compaction roller;

the means is a gas pressure spring, a torsion spring or a coil spring; and the means comprises an elastic actuation element.

8. The ground compaction apparatus according to claim 1, wherein an adjustment path limiting device is provided which limits the adjustment path of the cut material deflector relative to the edge processing roller and/or relative to the compaction roller.

9. The ground compaction apparatus according to claim 1, wherein the material guide surface extends along the roller rotation axis on both sides away from the mounting device toward and away from the edge processing roller.

10. The ground compaction apparatus according to claim 1, wherein the mounting device has, between the mounting arm and the material guide surface, a width bridging member extending in the direction parallel to the roller rotation axis and having an extension in the direction of the roller rotation axis corresponding to a range of 80% to 120% of the axial extension of the edge processing roller in the direction of the roller rotation axis.

11. The ground compaction apparatus according to claim 1, wherein the ground compaction apparatus has a collecting container arranged behind the material guide surface in the working direction (a), comprising a receiving opening and a material collecting region, the receiving opening being positioned such that material guided by the material guide surface in the material guiding position is guided into the receiving opening in the case of continued movement in the working direction.

12. The ground compaction apparatus according to claim 1, wherein the mounting device of the cut material deflector has either a mounting arm which can be rotated about an adjustment axis relative to the adjustable roller holding device of the cover edge processing apparatus and/or a mounting arm which is displaceable, in particular linearly, along an adjustment curve relative to the adjustable roller holding device of the edge processing apparatus.

13. The ground compaction apparatus according to claim 12, wherein the mounting arm of the mounting device of the cut material deflector is mounted coaxially to the roller rotation axis of the edge processing roller for rotation relative to the adjustable roller holding device.

14. An asphalt roller with a ground compaction apparatus according to claim 1.

15. The asphalt roller according to claim 14, wherein the asphalt roller comprises an articulated-steered or pivot-steered tandem roller.

16. A method for operating a ground compaction apparatus according to claim 1, with a compaction roller rotatably mounted on a support structure and a cover edge processing apparatus mounted on the support structure, comprising an edge processing roller, an adjustment arm as well as an adjustment drive, the edge processing roller being adjustable, driven by the adjustment drive, from a passive position into an edge processing position relative to the external surface of the compaction roller, the method comprising:

a) adjusting the cover edge processing apparatus from the passive position into the edge processing position relative to the external surface of the compaction roller, and b) automatically adjusting, simultaneously to step a), a cut material deflector relative to the cover edge processing apparatus.

17. The method according to claim 16, wherein adjusting the cut material deflector relative to the cover edge processing apparatus is performed depending on at least one of the following:

an adjustment position of the adjustment arm;

gravity; or interaction of the cut material deflector with the underlying ground.

* * * * *